United States Patent [19]

Waki et al.

[11] 4,313,187

[45] Jan. 26, 1982

[54] WATER RESISTING CROWN STRUCTURE FOR ELECTRONIC WRISTWATCHES

[75] Inventors: Masahiko Waki; Yasuo Maekawa, both of Tanashi, Japan

[73] Assignee: Citizen Watch Co., Ltd., Tokyo, Japan

[21] Appl. No.: 143,546

[22] Filed: Apr. 25, 1980

[30] Foreign Application Priority Data

Jan. 24, 1980 [JP] Japan ..... 55-7383[U]

[51] Int. Cl.[3] ..... G04B 29/00; G04B 27/02

[52] U.S. Cl. ..... 368/319; 368/190; 368/308

[58] Field of Search ..... 368/185–187, 368/190, 194, 195, 288, 290, 308, 319, 320

[56] References Cited

U.S. PATENT DOCUMENTS

| | | | |
|---|---|---|---|
| 2,309,428 | 1/1943 | Aegler | 368/288 |
| 3,362,153 | 1/1968 | Wenger | 368/290 |
| 3,389,551 | 6/1968 | Wyssen | 368/289 |
| 4,089,158 | 5/1978 | Wenger | 368/289 |

FOREIGN PATENT DOCUMENTS

| | | | |
|---|---|---|---|
| 241543 | 3/1946 | Switzerland | 368/289 |
| 290045 | 4/1953 | Switzerland | 368/290 |
| 488058 | 6/1938 | United Kingdom | 368/290 |
| 671819 | 5/1952 | United Kingdom | 368/290 |
| 740124 | 11/1955 | United Kingdom | 368/289 |

*Primary Examiner*—Vit W. Miska

*Attorney, Agent, or Firm*—Birch, Stewart, Kolasch and Birch

[57] ABSTRACT

A water resisting crown structure for electronic wristwatches comprises a guide pipe secured to a watch case, a crown stem slidably engaged in the guide pipe, and a crown locked to the guide pipe by a thread engagement. The guide pipe has an outwardly extending large diameter portion having a thread thereon. The crown stem is connected to a correcting means such as hands and calendar correcting means of the electronic wristwatch and has a non-circular flange on an outer end portion. The crown has an inner cylindrical portion and an outer cylindrical portion which are coaxial with the guide pipe and crown stem. The inner cylindrical portion has a non-circular inner wall engaged with the non-circular flange of the crown stem. The outer cylindrical portion has an inner thread adapted to be engaged with the thread of the guide pipe for locking the crown. A packing is provided in the annular space between the outer cylindrical portion and the inner cylindrical portion of the crown. The thread locking means, packing and non-circular engaging means are coaxially disposed, so that the width of the crown may be decreased.

3 Claims, 7 Drawing Figures

WATER RESISTING CROWN STRUCTURE FOR ELECTRONIC WRISTWATCHES

BACKGROUND OF THE INVENTION

The present invention relates to a water resisting crown structure for electronic wristwatches.

A water resisting handsetting crown secured to the watch case by thread means is known. FIG. 1 shows such a water resisting handsetting crown structure. A guide pipe 1 is secured to a hole 2*a* of a wrist watch case 2. The guide pipe 1 has an outside enlarged portion on which a thread 1*a* is provided. A crown stem 3 connected to a winding stem of the wristwatch is slidably engaged in the pipe 1 with a watertight sealing by a packing 4. The crown stem 3 has an axially extending bore 3*a*, a flange 3*b* and a non-circular peripheral portion 3*c*. A spring 5 is inserted in the bore 3*a*. A cylindrical crown 6 is provided with an inside flange 6*a* having a non-circular opening engageable with the non-circular peripheral portion 3*c*, with an inner thread 6*b* engaged with the thread 1*a*, with an annular groove 6*c* in which a packing 7 is engaged, and with a cylindrical end closure 6*d* secured to the outer end thereof.

FIG. 1 shows the crown locked to the pipe 1 by engagement between the threads 1*a* and 6*b*. If the thread locking is released, the crown 6 is outwardly projected by the spring 5 as shown in FIG. 2 so that the non-circular flange 6*a* is engaged with the non-circular peripheral portion 3*c*. When the crown 6 is rotated, the spring of the watch (not shown) is wound up through the crown stem 3. If the crown 6 is further pulled to the outward position shown in FIG. 3, the stem is connected to hands correcting device (not shown) so that hands correction may be carried out.

In such a crown structure, the thread locking means, packing and non-circular engaging portions are axially disposed. Consequently, it is difficult to decrease the thickness "H" of the crown. Therefore, even if the watch is made into a small size, the size of the crown can not be reduced, which impairs the look of the watch.

SUMMARY OF THE INVENTION

The object of the present invention is to provide a water resisting crown structure which may reduce the thickness of the crown according to the decrease of the watch case in size.

In accordance with the present invention, there is provided a water resisting crown structure for an electronic wristwatch comprising a guide pipe secured to the case of said wristwatch, said guide pipe having an outwardly projected large diameter portion and a thread formed on said large diameter portion, a crown stem slidably engaged in said guide pipe, said crown stem having a hole axially extending from the outer end thereof and a non-circular flange in an outer end portion, a cylindrical crown having an inner cylindrical portion adapted to be inserted in said large diameter portion and an outer cylindrical portion having inner thread engageable with said thread of said guide pipe, said inner cylindrical portion and outer cylindrical portion being coaxial with said crown stem and large diameter portion of said guide pipe, said inner cylindrical portion having a non-circular inner wall engaged with said non-circular flange, a packing provided in a space between said inner cylindrical portion and outer cylindrical portion, a spring provided in said hole of crown stem, and a projected means formed on said non-circular inner wall so as to engage with inside end of said non-circular flange.

Other objects will become more apparent from the following description with reference to the accompanying drawings.

DESCRIPTION OF THE PREFERRED EMBODIMENT

Figure 1:
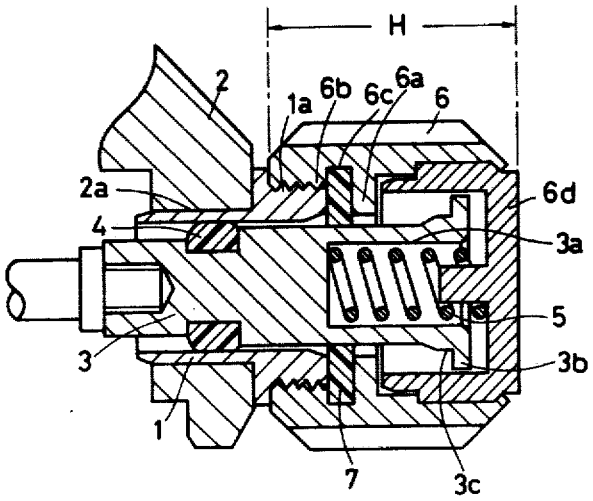
FIG. 1 is a sectional view showing a conventional crown structure in the locking position.
Figure 2:
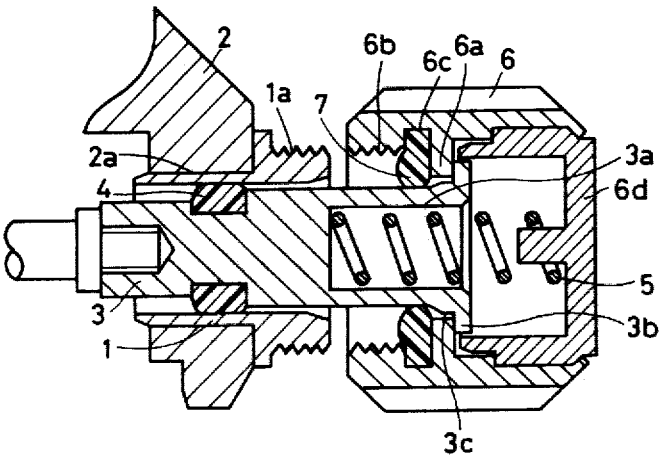
FIG. 2 is a sectional view showing the crown structure of FIG. 1 in the released position for winding the spring of the watch.
Figure 3:
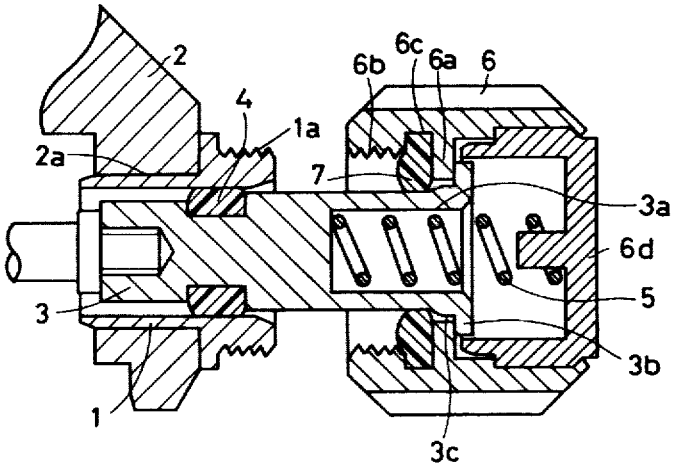
FIG. 3 is a sectional view showing the crown structure in the outermost position for setting the watch.
Figure 4:
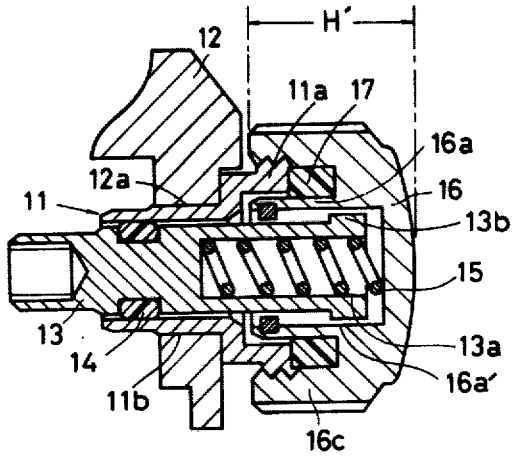
FIG. 4 is a sectional view showing a crown structure for an electronic wristwatch according to the present invention.
Figure 5:
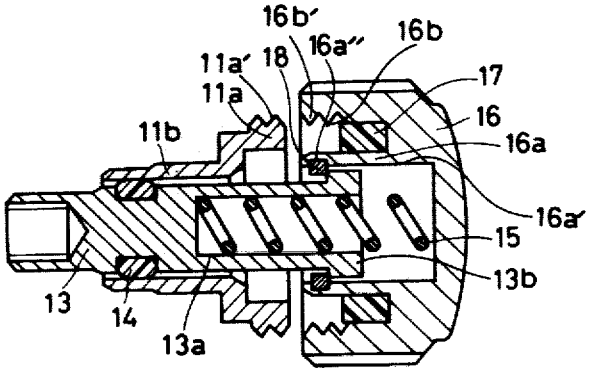
FIG. 5 is a sectional view of the crown structure of FIG. 4 in the released position.

Referring to FIGS. 4 and 5, a guide pipe 11 has an outwardly projected large diameter portion 11*a* having a thread 11*a*' and has a small diameter portion 11*b* which is secured in a hole 12*a* of a watch case 12. In the guide pipe 11, a crown stem 13 connected to a correcting means (not shown) of the electronic wristwatch is slidably engaged with a watertight sealing by a packing 14 provided in the annular groove of the stem. The crown stem 13 has a hole 13*a* axially extending from the outer end thereof and a non-circular flange 13*b* at the periphery of the outer end. A spring 15 is inserted into the hole 13*a*. A cylindrical crown 16 has an inner cylindrical portion 16*a* having a non-circular innermost axial hole portion 16*a*' engaged with the non-circular flange 13*b*, and has an outer cylindrical portion 16*c* having an intermediate inner wall 16*b*. The intermediate inner wall 16*b* has an inner thread 16*b*'. The inner cylindrical portion 16*a* and intermediate inner wall 16*b* are coaxial with the crown stem 13 and the large diameter portion 11*a*. In the cylindrical space between the inner cylindrical portion 16*a* and the intermediate inner wall 16*b*, a circular packing 17 is provided. The cylindrical space is adapted to receive the large diameter portion 11*a* and the inner cylindrical portion 16*a* is adapted to be inserted in the large diameter portion 11*a*. Thus, the thread 16*b*' may be engaged with the thread 11*a*'. A ring 18 is engaged with an inner annular groove 16*a*'' and secured thereto by caulking the end of the inner cylindrical portion 16*a*, so that the ring 18 may be engaged with the inside end of the flange 13*b*.

FIG. 4 shows a locking position of the crown, in which the crown 16 is pushed against the spring 15 and the thread 16*b*' is engaged with the thread 11*a*' thereby locking the crown. Since the non-circular innermost axial hole portion 16*a*' is engaged with the flange 13*b*, via ring 18, rotation of the crown 16 for locking causes the crown stem 13 to rotate. However, since the electronic wristwatch does not have a spring in its winding mechanism, the rotation of the stem has no influence on the watch. In the position of FIG. 4, the crown structure is sealed with packings 14 and 17 to provide a watertight sealing.

Figure 6:
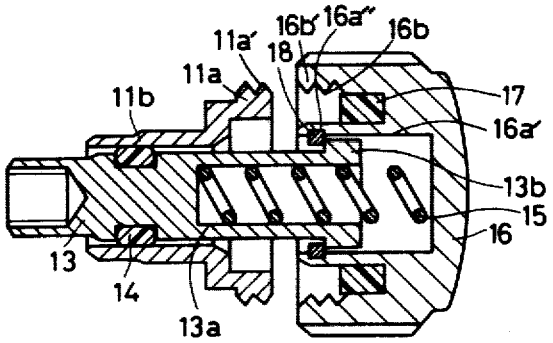
FIG. 6 is a section of the crown structure in an intermediate position for correcting a calendar.
Figure 7:
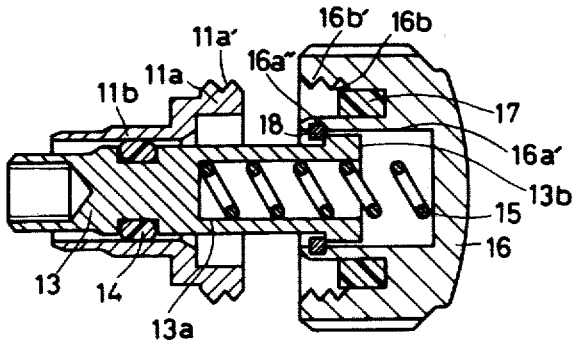
FIG. 7 is a section of the crown structure in the outermost position for setting the watch.

When the thread locking of the crown 16 is released, the crown is outwardly projected by the action of the spring 15 so that the ring 18 engages with the end of the flange 13*b* as shown in FIG. 5. Accordingly, if the crown 16 is pulled one step, the crown stem 13 is pulled to the intermediate position shown in FIG. 6. In the intermediate position, when the crown 16 is rotated, the crown stem 13 is rotated by the engagement between the non-circular axial hole portion 16*a*' and the non-circular flange 13*b* thereby to correct the calendar such as date, day or month. Further, when the crown is pulled to the outermost position shown in FIG. 7, rotation of the crown causes the hands to rotate for setting the watch.

In accordance with the present invention, since the thread locking means, packing means and non-circular engaging means are coaxially disposed in the radial direction, the width of the crown may be reduced according to a decrease of the watch in size.

What is claimed is:

1. A crown structure for an electronic wristwatch, comprising:

a guide pipe secured to the case of said wristwatch, said guide pipe having an outwardly projected large diameter portion and a thread formed on said large diameter portion, a crown stem slidable engaged in said guide pipe, said crown stem having a hole axially extending from the outer end thereof and a non circular flange in an outer end portion, a cylindrical crown having an inner cylindrical portion adapted to be inserted in said large diameter portion and an outer cylindrical portion having an inner thread engageable with said thread of said guide pipe, said inner cylindrical portion and outer cylindrical portion being coaxial with said crown stem and large diameter portion of said guide pipe, said inner cylindrical portion having an axial hole portion having a non-circular cross-section engaged with said non-circular flange, a packing provided in a space between said inner cylindrical portion and outer cylindrical portion, a spring provided in said hole of said crown step, and a projected means formed on the inner wall of said axial hole portion so as to engage with the inside end of said non-circular flange.

2. A crown structure for electronic wristwatches according to claim 1 further comprising a packing provided between said guide pipe and said crown stem.

3. A crown structure for electronic wristwatches according to claim 1 wherein said projected means is a ring secured to said non-circular inner wall.

* * * * *